US008713839B2

(12) United States Patent
Carlock

(10) Patent No.: US 8,713,839 B2
(45) Date of Patent: May 6, 2014

(54) FIREARM THROAT AND RIFLING METHOD

(76) Inventor: Shawn Carlock, Rathdrum, ID (US)

( * ) Notice: Subject to any disclaimer, the term of this patent is extended or adjusted under 35 U.S.C. 154(b) by 75 days.

(21) Appl. No.: 13/298,053

(22) Filed: Nov. 16, 2011

(65) Prior Publication Data

US 2012/0117846 A1 May 17, 2012

Related U.S. Application Data

(60) Provisional application No. 61/414,389, filed on Nov. 16, 2010.

(51) Int. Cl.
*F41A 21/00* (2006.01)

(52) U.S. Cl.
USPC ..... 42/78; 42/76.01; 42/77; 42/79

(58) Field of Classification Search
USPC ..... 42/76.01–79; 89/14.04–14.7
See application file for complete search history.

(56) References Cited

U.S. PATENT DOCUMENTS

| | | | | |
|---|---|---|---|---|
| 1,329,444 | A * | 2/1920 | Thompson | 42/78 |
| 2,700,839 | A * | 2/1955 | Finlay et al. | 42/79 |
| 4,712,465 | A * | 12/1987 | Macdonald | 89/16 |
| 2005/0011102 | A1 * | 1/2005 | Boyer | 42/79 |

* cited by examiner

*Primary Examiner* — Samir Abdosh
(74) *Attorney, Agent, or Firm* — Dean A Craine

(57) ABSTRACT

A firearm with a barrel that uses an ammunition discharge chamber that includes improved throat located between the chamber's free bore and the rifle bore. The improved throat includes a relatively short, inward aligned first step, an intermediate elongated cylindrical body, and a longer, inward aligned second tapered step. Formed on the inside surfaces of the first step, the elongated body and the second step are rifling grooves and lands that gradually their depths and heights from rear to front direction. The two steps are tapered inward between 1.0 to 1.5 degrees. Using a short first step, an elongated cylindrical body with straight sidewalls, a longer second step with continuous grooves and lands that begin gradually in depth and height from rear to front directions, chamber pressure is reduced thereby enabling more gun powder to be used and bullet misalignment in the rifle bore is reduced.

5 Claims, 3 Drawing Sheets

FIREARM THROAT AND RIFLING METHOD

This utility patent application is based upon and claims the filing date benefit of U.S. provisional patent application (Application No. 61/414,389) filed on Nov. 16, 2010.

COPYRIGHT NOTICE

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention relates firearms and more particularly to firearm barrels with rifling.

2. Description of the Related Art

A rifle typically includes a chamber on the breach end of a rifle where an ammunition cartridge is placed. The cartridge typically includes a cylindrical case filled with primer and gun with a bullet located at its opposite open end, called the mouth. The case is held in the chamber so that when the trigger is pulled, a firing pin contacts the head of the cartridge causing the primer and gunpowder to ignite and force the bullet out the mouth.

Located immediately adjacent to the chamber is a short narrow throat slightly larger in the diameter than the bullet. The throat includes a short cylindrical body with a single, short tapered step formed at its forward end that gradually narrows and communicates with the rifle bore. Formed on the inside surface of the tapered step and extending the entire length of the rifle bore is at least one engraving groove that creates rifling on the sides of the bullet. When a cartridge is discharged, the bullet travels through the free bore, into the tapered step and then into the rifle bore. While traveling through the throat, the bullet is forced into coaxially alignment with the rifle bore and undergoes engraving.

SUMMARY OF THE INVENTION

At the heart of the invention is the discovery that short throats with single tapered steps used in the prior as shown in FIG. 1, with uniform depth rifling grooves experience relatively high chamber pressure. Because chamber pressure is high, the amount of gun powder that may be placed in the cartridge is limited thereby restricting the muzzle velocity of the bullet. It is also discovered that short throats with a single tapered step with uniform depth and height rifling grooves and lands, the bullet may be misaligned in the rifle bore causing misalignment of the rifling grooves formed on the bullet thereby reducing accuracy.

It has been discovered that a firearm with an improved throat with a cylindrical elongated body with straight side walls and being slightly smaller in diameter than the diameter of the adjacent free bore, with a first step at one end that extends between the free bore and the elongated body, and second step at the opposite end that communicates with the rifle bore address the high chamber pressure problem and bullet misalignment problems discussed above. More specifically, both the first and second steps are longitudinally aligned and beveled inward 1.0 to 1.5degree. In the preferred embodiment, the length of the first step is slightly shorter than the length of the second step. Formed on the inside side walls of the elongated body is at least one continuous, rifling land and groove. In the preferred embodiment, the rifling land and groove start in the inside wall of the first step and then extend continuously through the elongated body, the second step and into the rifle bore. Also, the rifling groove and land gradually increase from rear to front direction so engraving on the sides of the bullet occurs gradually.

Because the bullet moves through three sections each with smaller diameters before entering the rifle bore and because engraving begins gradually, overall resistance to the longitudinal movement of the bullet is reduced. Reduced resistance to the bullet causes less peak chamber pressure enabling more powder to be used. By using more powder, greater muzzle velocity may be achieved. Also, because the first step is relatively short and the elongated body is slightly larger in diameter than the rifle bore, the gradual increase of the groove and land formed ensures the bullet is coaxially aligned prior to entering the rifle bore.

DESCRIPTION OF THE PREFERRED EMBODIMENT(S)

Figure 1:
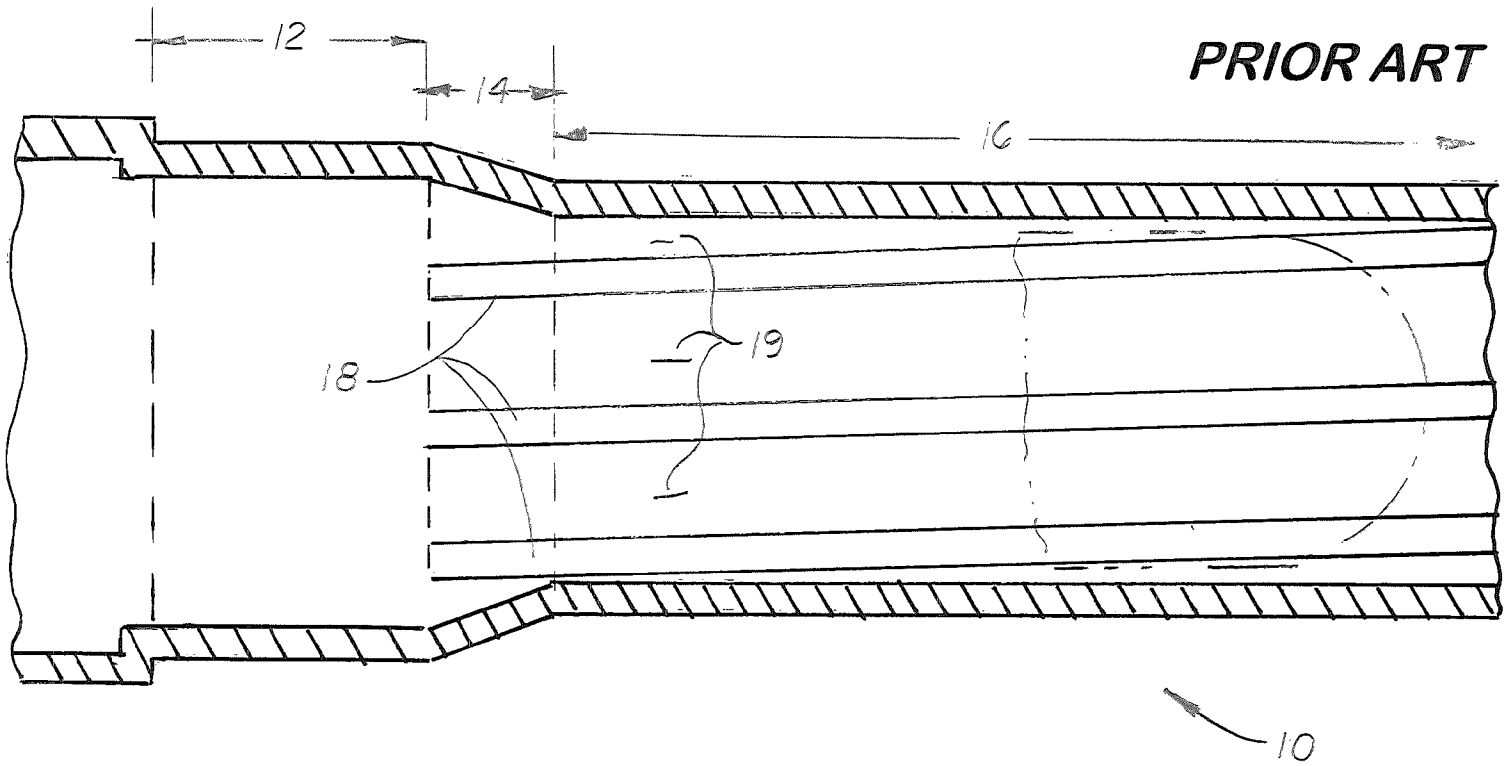
FIG. 1 is an illustration (not drawing to scale) of a side elevational view of a discharge chamber in the prior art showing the short intermediate tapered throat located between the free bore and the rifle bore with rifling grooves and lands that extend continuously from the tapered throat to the rifle bore.

FIG. 1 is a side elevational view of a firearm discharge chamber 10 in the prior art showing a short intermediate tapered throat 14 located between the free bore 12 and the rifle bore 16 with engraved rifling grooves 18 and lands 19 formed on the inside surface that extend continuously from the tapered throat 14 to the rifle bore 16. As mentioned above, a drawback with such chamber designs is the formation of high chamber pressure when the bullet is fired and the misalignment of the bullet prior entering the rifling area.

Figure 2:
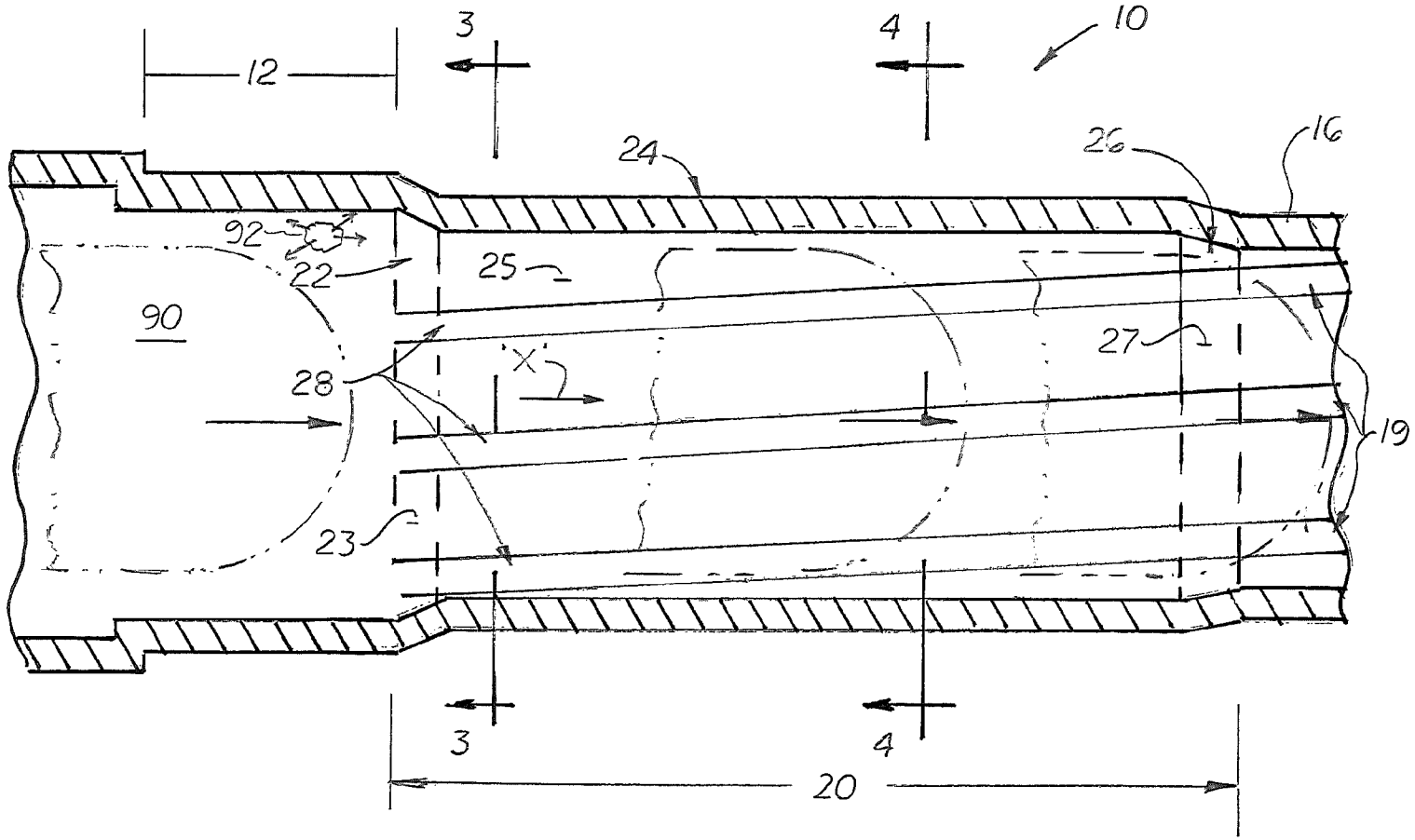
FIG. 2 is an illustration (not drawn to scale) of a side elevational view of a discharge chamber with an improved throat that includes a short first step, an elongated body, a short second step and gradually increasing grooves and lands the extend continuously through the improved throat.
Figure 3:
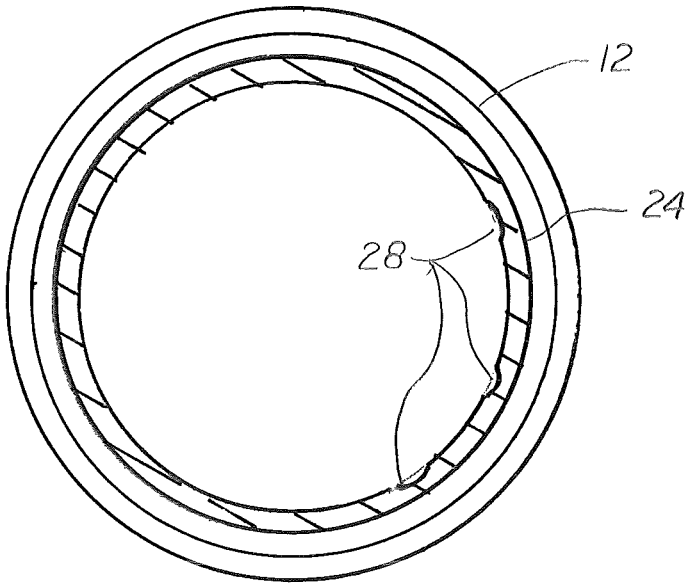
FIG. 3 is an illustration (not drawn to scale) of a sectional elevational view taken along line 3-3 in FIG. 2.
Figure 4:
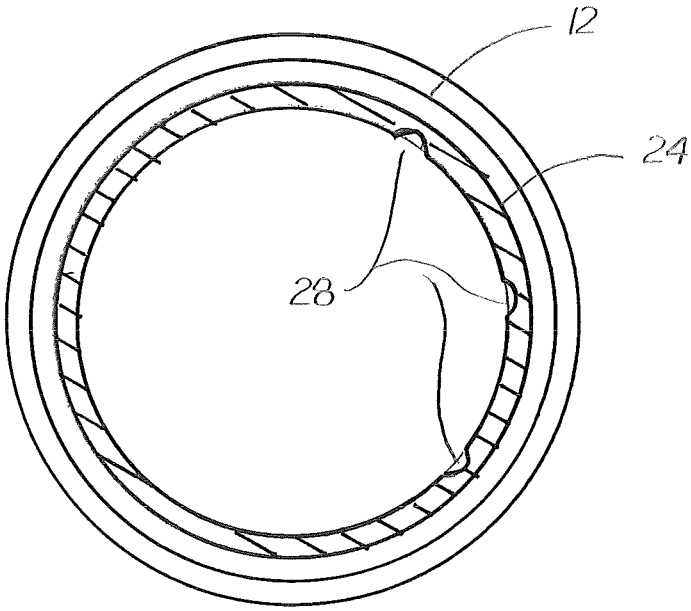
FIG. 4 is an illustration (not drawn to scale) of a sectional elevational view taken along line 4-4 in FIG. 2.

FIG. 2 is an illustration of a side elevational view of a discharge chamber 10' with an improved throat 20 that includes a short first step 22, an elongated cylindrical body 24, a short second step 26 and gradually increasing grooves 28 that extend continuously into the rifle bore 16. The elongated boy 24 includes straight side walls 25 and its diameter and length and the angles and lengths of the first and second steps 22, 26 depend upon the caliber of the bullet 90 and the diameters of the free bore 12 and the rifle bore 16. The throat 20 shown in FIG. 2, which not drawn to scale, includes a relatively short beveled or tapered first step 22 at an angle of 1.0 to 1.5 degree. For a 338 caliber bullet, the free bore 12 is approximately 0.3385 inches in diameter. The elongated body 24 has a continuous diameter approximately 0.0025 inches less than the diameter of the free bore 12 and 0.0025 inches greater than the rifle bore 16. The minimum length of the elongated body 24 is the length of the bullet used in the firearm (0.125 to 0.75 inches) and the maximum length of the elongated body 24 is approximately four times the length of the bullet. The second step 26 is integrally formed on the end of the elongated body 24 and is also beveled inward between 1 to 1.5 degree. The rifle bore 16 is typically 0.3330 inches in diameter therefore, the first step 22 and second step 26 when combined add up to the difference of the diameters of the free bore 12 and the rifle bore 16, (approximiately 0.0045 inches). The difference may be evenly distributed to the two steps 22, 26 or split in one of the following ratios: 25:75; 40:0; 60:40 or 75:25.

In the preferred embodiment, the first step 22 is slightly smaller in length than the second step 26. It should be understood, however, that steps 22 and 26 may be the same lengths and the length of first step 22 may be greater than the second step 26 in some rifles. The actual lengths of the steps 22 and 26 depend on the diameter of the free bore 12, the diameter and length of the elongated body 24, and the diameter of the rifle bore 16.

Formed on the inside surfaces, 23, 25, and 27 of the first step 22, the elongated body 24, and the second step 26, respectively, is at least one engraved continuous spiral groove 28. Three spiral grooves 28 are shown in FIG. 2. As mentioned above, the elongated body 24 is cylindrical with straight side walls. Therefore, the land (the area on the inside surface 25 in between the groove 28) has the same diameter. In the preferred embodiment, the depth of the groove 28 gradually increases when moving along a rear to front direction (indicated by direction 'X' in FIG. 2). Also, in the preferred embodiment, the groove 28 begins in the inside surface 23 of the first step 22 and extends through the inside surface 25 of the elongated body 24 and along the inside surface 27 of the second step 26. The groove 28 gradually increases in depth as it travels forward and eventfully joins or meshes with the rifling groove 19 framed on the inside surface of the rifle bore 16.

As stated previously, when discharged the bullet 90 moves from the free bore 12 through three different sections 22, 24, 26 each with gradually decreasing diameters. The bullet 90 then travels into the rifle bore 16 where it undergoes greater engraving. The engraving process, however, begins in the first step 22 and gradually increases. Because engraving is gradual, overall resistance to the longitudinal movement of the bullet 90 is reduced. Peak chamber pressure 92 is reduced thereby enabling more gun powder to be used which results in increased velocity of the bullet 90. Also, because the first step 22 is relatively short, and elongated body 24 is slightly larger in diameter than the rifle bore 16, and the grooves 28 gradually increase, the bullet 90 is initially coaxially aligned with the rifle bore 16 before entering the rifle bore 16.

Using the above described throat, a method of producing rifling on a bullet when discharged from a rifle is described that uses a rifle that includes a chamber with a longitudinally aligned free bore and a rifle bore, the method comprising moving the bullet upon discharge through a throat disposed between said free bore and said rifle bore, said throat that includes a cylindrical, elongated body with an inward directed, beveled first step at one end and located adjacent to said free bore and an inward directed, beveled second step located at the opposite end of said elongated body, said throat also includes at least one continous spiral groove that gradually increases in depth from the rear to the front direction.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A firearm throat coaxially aligned and disposed between the free bore and rifle bore for reducing chamber pressure and improving bullet accuracy, comprising;

a. a short first step located adjacent to the free bore of a rifle, said first tapered step being beveled inward from said free bore and includes an inside surface;

b. a cylindrical elongated body extending forward from said first step, said elongated body includes straight side walls with an inside surface;

c. a short second step attached to or integrally formed on an end of said elongated body opposite said first step, said second step being beveled inward and coaxially aligned at one end with said elongated body to match the smaller diameter rifle bore adjacent to said elongated body, said second step includes an inside surface; and, d. at least one continuous spiral groove formed on said inside surfaces of said first step, said elongated body, and said second step, said spiral groove configured to engrave rifling on said bullet as it travels from said free bore and into said rifle bore.

2. The firearm throat, as recited in claim 1, wherein said spiral groove formed on said inside surfaces of said first step, said elongated body, and said second step gradually increases in depth from a rear to front direction.

3. The firearm throat, as recited in claim 1, wherein said first step and said second step are beveled inward 1 to 1.5 degrees.

4. A firearm throat disposed between the free bore and the bore of a rifle for reducing chamber pressure and improving bullet accuracy, comprising;

a. a first step located adjacent to the free bore of a rifle, said first step includes an inside surface, said first step being beveled inward 1 to 1.5 degrees;

b. an elongated cylindrical body attached or integrally formed with said first step, said elongated body extending forward from said first step and includes straight side walls with an inside surface;

c. a second step attached to or integrally formed with said elongated body, said second step being attached or integrally formed with said rifle bore and beveled inward and coaxially aligned at one end with said elongated body and with a smaller diameter rifle bore said second step includes an inside surface, said second step being beveled inward 1 to 1.5 degrees; and, d. at least one continuous spiral groove formed on the said inside surfaces of said first step, said elongated body, and said second step, said spiral groove being configured to gradually engrave rifling on said bullet as it travels from said free bore, through said elongated body, and into said rifle bore, said spiral groove formed on said inside surfaces of said first step, said elongated body, and said second step gradually increases in depth from a rear to front direction.

5. A method of producing rifling on a bullet when discharged from a rifle, the rifle includes a chamber with a longitudinally aligned free bore and a rifle bore, the method comprising moving the bullet upon discharge through a throat disposed between said free bore and said rifle bore, said throat includes a cylindrical, elongated body with an inward directed, beveled first step at one end and located adjacent to said free bore and an inward directed, beveled second step at the opposite end of said elongated body, said throat also includes at least one continuous spiral groove configured to produce rifling on a bullet, said spiral groove extends from said first step, through said elongated body and said second step and gradually increases in depth from said first step to said second step.

* * * * *